US008303603B2

(12) United States Patent
Sanchez-Martinez et al.

(10) Patent No.: US 8,303,603 B2
(45) Date of Patent: Nov. 6, 2012

(54) CLAMPING DEVICE FOR AN EPLIATION DEVICE

(75) Inventors: Pedro Sanchez-Martinez, Kronberg (DE); Robert Damaschke, Eschborn (DE); Michael Klotz, Schoneck (DE); Frieder Grieshaber, Neu-Anspach (DE); Christof Ungemach, Frankfurt am Main (DE); Ralf Dorber, Oberursel (DE)

(73) Assignee: Braun GmbH, Kronberg (DE)

( * ) Notice: Subject to any disclaimer, the term of this patent is extended or adjusted under 35 U.S.C. 154(b) by 554 days.

(21) Appl. No.: 11/576,120

(22) PCT Filed: Jul. 29, 2005

(86) PCT No.: PCT/EP2005/008233

§ 371 (c)(1),
(2), (4) Date: Apr. 23, 2007

(87) PCT Pub. No.: WO2006/037393

PCT Pub. Date: Apr. 13, 2006

(65) Prior Publication Data

US 2007/0212923 A1 Sep. 13, 2007

(30) Foreign Application Priority Data

Oct. 1, 2004 (DE) ..... 10 2004 047 875

(51) Int. Cl.
*A61B 17/50* (2006.01)

(52) U.S. Cl. ..... 606/133

(58) Field of Classification Search ..... 606/131, 606/133, 210

See application file for complete search history.

(56) References Cited

U.S. PATENT DOCUMENTS

| | | | | |
|---|---|---|---|---|
| 3,735,765 | A * | 5/1973 | Ichelson | 606/135 |
| 4,575,902 | A * | 3/1986 | Alazet | 19/2 |
| 5,041,123 | A * | 8/1991 | Oliveau et al. | 606/133 |
| 6,591,843 | B1 * | 7/2003 | Langohr | 132/277 |

FOREIGN PATENT DOCUMENTS

| | | |
|---|---|---|
| DE | 690 04 345 | 2/1994 |
| EP | 0 342 546 | 5/1989 |
| EP | 0 547 386 | 11/1992 |
| WO | WO2004/054402 | 7/2004 |

* cited by examiner

*Primary Examiner* — S Thomas Hughes
*Assistant Examiner* — Sarah Simpson
(74) *Attorney, Agent, or Firm* — David K Mattheis; Kim W Zerby

(57) ABSTRACT

A clamping device for a motor-driven epilation apparatus. The clamping device has a first clamping element with a first contact surface, in the region of which a three-dimensional clamping structure is provided. The clamping device has a second clamping element with a second contact surface. The contact surfaces of the clamping elements are intermittently brought in mutual clamping contact during the operation of the epilation apparatus. The hardness of the second clamping element in the region of the second contact surface is lower than that of the first clamping element in the region of the first contact surface.

11 Claims, 2 Drawing Sheets

CLAMPING DEVICE FOR AN EPLIATION DEVICE

TECHNICAL FIELD

The invention pertains to motor-driven epilators and associated epilation heads and clamps.

BACKGROUND

Epilation apparatuses serve for removing hairs, if possible inclusive of their roots. Known epilation apparatuses are designed, for example, such that the hairs are clamped between adjacent clamping elements and plucked due to a movement of the clamping elements relative to the skin. In order to ensure that the hairs are reliably plucked out of the skin and that the utilization of the epilation apparatus can be realized in a largely pain-free fashion, it is necessary to firmly clamp the hairs between the clamping elements. This can be achieved by pressing the clamping element against one another with a high contact pressure. However, the contact pressure that can be generated with a justifiable expenditure is limited. In addition, a higher contact pressure also results in a more substantial noise development of the epilation apparatus, and there is a higher risk of damaging the hairs so severely under the pressure of the clamping elements that they tear during the plucking process and are not removed in their entirety, if at all.

Other measures for reliably clamping the hairs during the plucking process are disclosed in U.S. Pat. Nos. 5,041,123 and 4,575,902.

U.S. Pat. No. 5,041,123 discloses an epilation apparatus that features a row of disks that are fixed on a hub in the form of a parallel arrangement. Thin plates are arranged between the disks and can be respectively pressed against the edge region of the adjacent disk. The contact surface between the disks and the plates can be roughened in order to reliably clamp the hairs.

U.S. Pat. No. 4,575,902 discloses an epilation apparatus with a row of tight-fitting disks that collectively form a rotatable roller. During this rotation, the disks are respectively deformed in such a way that adjacent disks are pressed against one another, such that the hairs are clamped between the disks and plucked out of the skin due to the rotational movement. In order to prevent the clamped hairs from sliding out, the disks can be subjected to a surface roughening treatment. It would also be possible to produce grooves or other depressions or elevations on the surfaces of the disks.

The risk of the hairs sliding out of the closed clamping elements can be reduced by utilizing clamping elements with a roughened surface or a surface that features grooves or other elevations or depressions. Depending on the surface structure of the clamping elements, the percentage of torn hairs may, however, also increase in such instances because a surface with sharp-edged structures, in particular, can cause more damage to the clamped hairs.

SUMMARY

One aspect of the invention features a clamping device for a motor-driven epilation apparatus including a first clamping element with a first contact surface, in the region of which a three-dimensional clamping structure is realized. The clamping device further includes a second clamping element with a second contact surface. The contact surfaces of the clamping elements are intermittently brought in mutual clamping contact during the operation of the epilation apparatus. The hardness of the second clamping element in the region of the second contact surface is lower than that of the first clamping element in the region of the first contact surface.

Hairs can be clamped reliably, yet carefully. The risk of the hairs sliding out of the closed clamping device is comparatively low. The risk of damaging the clamped hairs so severely that they tear is also quite low. Therefore, a user is substantially prevented from experiencing unnecessary pain if the utilization of the epilation apparatus does not result in hairs being plucked out of the skin. The hairs can be reliably clamped with a lower mutual contact pressure between these contact surfaces. This not only reduces the noise development when the contact surfaces are brought in mutual clamping contact, but also lowers the stress on the individual components, and therefore the wear. The soft second contact surface also has sound-damping and vibration-reducing characteristics.

In some embodiments, the difference in hardness between the contact surfaces of the clamping elements is preferably high enough that the clamping structure is at least temporarily and/or partially molded into the second contact surface of the second clamping element when the clamping elements are brought in mutual clamping contact. This boosts the clamping effect and also prevents the clamping structure from obstructing the closing of the clamping device.

In some embodiments, the average roughness Ra of the second clamping element in the region of the second contact surface is preferably lower than that of the first clamping element in the region of the first contact surface. The first clamping element can be movably arranged in such a way that the distance between the contact surfaces of the clamping elements is variable. This means that the opening and closing of the clamping device is preferably realized with the aid of the first clamping element that also features the clamping structure.

The clamping structure may be realized, for example, in the form of a stochastic roughness structure. Such a structure can be inexpensively produced. Alternatively, it is also possible to realize the clamping structure in the form of an ordered geometric structure, particularly in the form of elevations or depressions that extend parallel to one another. An advantage of this measure can be seen in that the clamping behavior of the clamping device can be very specifically influenced.

In some embodiments, the clamping device is preferably designed such that the clamping structure has an average roughness Ra of less than 2 μm, for example less than 1 μm. It is furthermore advantageous if the clamping structure has an average surface roughness Rz of less than 10 μm, for example less than 6 μm. The maximum surface roughness Rmax of the clamping structure may lie between 2 μm and 10 μm. Preferred values for the average distance RSM between adjacent elevations or depressions of the clamping structure are smaller than 100 μm, for example smaller than 45 μm.

The first clamping element may be made of metal in the region of the first contact surface. The second clamping element is preferably made of plastic in the region of the second contact surface.

Another aspect of the invention features an epilation head that includes at least one inventive clamping device.

Another aspect of the invention features an epilation apparatus with a hand-held housing and an epilation head of this type.

Other aspects features and advantages will be apparent from the following detailed description, the drawings, and the claims.

DETAILED DESCRIPTION

Figure 1:
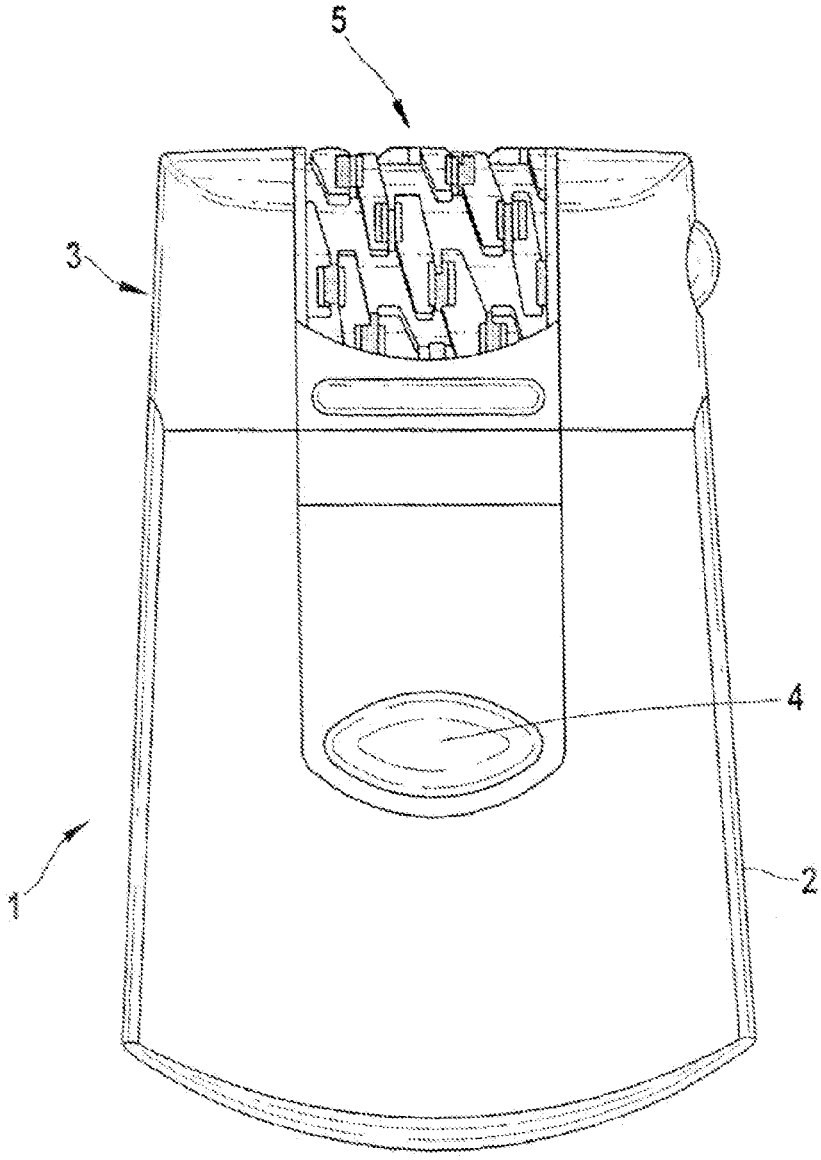
FIG. 1 is a side view of an embodiment of an epilation apparatus.

FIG. 1 shows an embodiment of an epilation apparatus 1 in the form of a side view. The epilation apparatus 1 features a housing 2 and an epilation head 3 that is detachably fixed on the housing 2. The housing 2 is shaped such that it can be comfortably held in one hand. A switch 4 for switching the epilation apparatus 1 on and off is arranged on the housing 2. A rotatable cylinder 5 is rotatably suspended in the epilation head 3.

Figure 2:
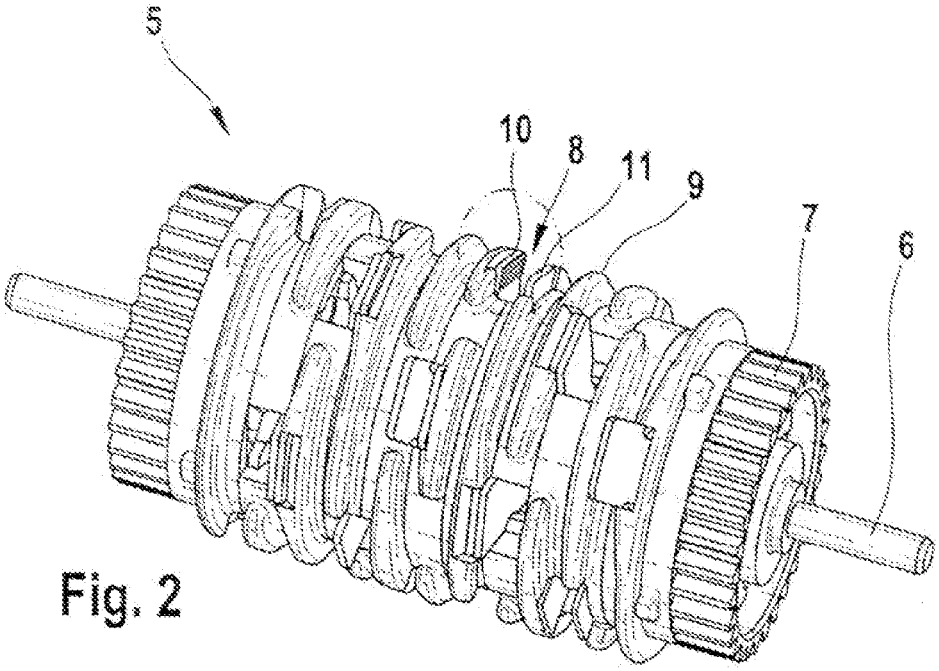
FIG. 2 is a perspective representation of an embodiment of the rotatable cylinder of the epilation apparatus.

FIG. 2 shows an embodiment of the rotatable cylinder 5 in the form of a perspective representation. The encircled detail is illustrated in an enlarged fashion in FIG. 3. The rotatable cylinder 5 is rotatably supported in the epilation head 3 by means of a shaft 6. One respective gear 7 is connected to the rotatable cylinder 5 in a rotationally rigid fashion in the region of the two axial ends of the rotatable cylinder 5. The gears 7 make it possible to drive the rotatable cylinder 5 with an electric motor that is not illustrated in the figures and situated in the interior of the housing 2, shown in FIG. 1. In the axial direction, the rotatable cylinder 5 is composed of a multitude of stacked components. The following description only pertains to the clamping devices 8 that are embedded in carrier disks 9 and respectively include a first clamping element 10 and a second clamping element 11.

Figure 3:
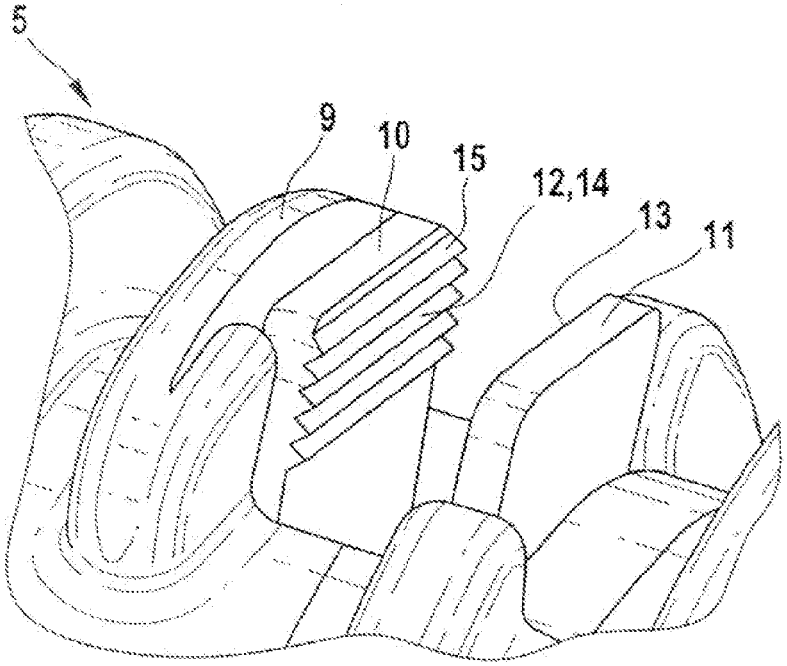
FIG. 3 is an enlarged detail of FIG. 2 in the region of one of the clamping devices.

FIG. 3 shows an enlarged detail of FIG. 2 in the region of one of the clamping devices 8. The first clamping element 10 is suspended in the rotatable cylinder 5 such that it can be respectively tilted relative to the shaft 6, and thus moved axially toward the corresponding second clamping element 11 and away therefrom. The second clamping elements 11 are fixedly arranged within the rotatable cylinder 5. The second clamping elements 11 may be realized in one piece with the carrier disks 9. The clamping devices 8 consequently can be opened and closed due to the movements of the first clamping elements 10. The first clamping elements 10 respectively feature a first contact surface 12 and the second clamping elements 11 respectively feature a second contact surface 13 in order to clamp the hairs. When the clamping device 8 is closed, the first contact surface 12 of the first clamping element 10 and the second contact surface 13 of the second clamping element 11 are pressed against one another. In FIG. 3, the first clamping element 10 is situated at its maximum distance from the corresponding second clamping element 11 such that the clamping device 8 is completely opened.

During the operation of the epilation apparatus 1, the rotatable cylinder 5 is set in rotation such that all clamping devices 8 of the rotatable cylinder 5 rotate therewith. During this process, each clamping device 8 is periodically closed and opened in accordance with the rotational movement of the rotatable cylinder 5 due to a tilting motion of the respective first clamping element 10. Hairs situated in the region between the contact surfaces 12 and 13 of the clamping elements 10 and 11 are clamped therebetween during the closing of the clamping devices 8, and thus fixed on the respective clamping device. Due to the rotational movement of the rotatable cylinder 5, the clamping devices 8 continue to participate in the rotational movement together with the clamped hairs such that the hairs are plucked out of the skin. The clamping devices are subsequently opened again such that the plucked hairs are released. In some embodiments, the clamping element 11 can be actuated relative to a stationary clamping element 10 or both clamping elements 10 and 11 can be actuated.

In order to prevent the hairs from sliding out of the closed clamping devices 8 during the plucking process, a clamping structure 14 featuring a multitude of parallel elevations 15 is provided in the region of the first contact surfaces 12 of the first clamping elements 10. These elevations 15 have an essentially triangular cross section and extend over the entire width of the respective first clamping element 10, namely transverse to the radial direction of the rotatable cylinder 5. In some embodiments, the elevations 15 may also have a different cross section. In other embodiments, the clamping structure 14 features an altogether different type of topography. In addition to regularly arranged structures, stochastic roughness structures can be realized. Regular structures can be produced, for example, with embossing methods. Sand blasting methods are used, for example, for producing stochastic structures.

Excessive damage to the hairs during the clamping between the clamping elements 10 and 11 is prevented because the hardness of the second clamping elements 11 in the region of their second contact surfaces 13 is lower than that of the first clamping elements 10 in the region of their first contact surfaces. The influence of the clamping structure 14 on the hairs is partly absorbed in a springable fashion in this case. Due to the hardness of the first clamping element 10 in the region of its first contact surface 12, the raised structural elements of the clamping structure are respectively molded into the softer second contact surfaces 13 of the second clamping elements 11 over time 14. The first clamping elements 10 may be made, for example, of metal and the second clamping elements 11 may be made of plastic.

In order to achieve an adequate clamping effect, the clamping structure 14 is adapted to the surface structure of the hairs. The clamping structure 14 is realized, such that it can engage into the imbricated surface structure of the hairs. For this purpose, the clamping structure 14 has an average roughness Ra of less than 2 μm, for example less than 1 μm. The average roughness Ra is defined as the arthritic mean of all deviations of the surface structure from a center line that extends transversely through the clamping structure 14. The average surface roughness Rz of the clamping structure 14 represents an arithmetic mean of five individual surface roughness measurements on five individual adjacent sections and amounts to less than 10 μm, for example less than 6 μm. The maximum surface roughness Rmax of the clamping structure 14 lies between 2 μm and 10 μm and reflects the greatest individual surface roughness within the entire measuring section. Values below 100 μm, for example below 45 μm, are used for the average distance RSM between the raised structural elements of the clamping structure 14. A detailed definition of the average distance RSM can be found in Standard DIN EN ISO 4287 or ASME B46.1, respectively. In this case, the roughness values apply regardless of the alignment on the corresponding surface.

Within the aforementioned ranges for the roughness parameters, the clamping structure 14 has sufficient non-slip properties for reliably fixing the hairs, and the clamping structure is not so sharp-edged such that it may damage the hairs during the clamping process to such a degree that they tear. In some embodiments, an optimal result is obtained if all roughness parameters lie within the cited ranges. However, in other embodiments it is possible that one roughness parameter or several roughness parameters deviate(s) from the cited ranges.

The scope of the invention also covers a multitude of modifications of the illustrated embodiments of a clamping device 8. For example, it would be possible to respectively arrange the second clamping element 11 in the rotatable cylinder 5 in a movable fashion rather than the first clamping element 10. It would also be conceivable that both clamping elements 10 and 11 are movably arranged in the rotatable cylinder 5.

The invention claimed is:

1. A motor-driven epilator comprising:

a housing; and an epilation head mounted on the housing, the epilation head comprising:

a first clamping element with a first contact surface forming a three-dimensional clamping structure defining a series of elevations spaced apart at an average distance of less than 100 μm between adjacent elevations and having an average roughness of less than 10 μm; and a second clamping element with a second contact surface softer than the first contact surface, wherein the contact surfaces of the clamping elements are intermittently brought in mutual clamping contact during operation of the epilator in a manner that causes elevations of the clamping structure of the first contact surface to deform regions of the second contact surface.

2. The epilator according to claim 1, wherein the second contact surface has a lower average roughness than the first contact surface.

3. The epilator according to claim 1, wherein the first clamping element is movably arranged such that a distance between the contact surfaces of the clamping elements is variable.

4. The epilator according to claim 1, wherein the clamping structure comprises a stochastic roughness structure.

5. The epilator according to claim 1, wherein the clamping structure comprises an ordered geometric structure.

6. The epilator according to claim 1, wherein the clamping structure has an average roughness of less than 2 μm.

7. The clamping device according to claim 6, wherein the clamping structure has an average roughness of less than 1 μm.

8. The epilator according to claim 1, wherein the first contact surface is metal.

9. The epilator according to claim 1, wherein the second contact surface is plastic.

10. The clamping device according to claim 1, wherein the clamping structure has an average surface roughness of less than 6 μm.

11. The clamping device according to claim 1, wherein the average distance between adjacent elevations is less than 45 μm.

* * * * *